United States Patent [19]

Smith

[11] 4,221,110

[45] Sep. 9, 1980

[54] YARN PIECING DEVICE FOR OPEN-END SPINNING MACHINES

[75] Inventor: Alan Smith, Accrington, England

[73] Assignee: Platt Saco Lowell Limited, Helmshore, England

[21] Appl. No.: 942,739

[22] Filed: Sep. 14, 1978

[30] Foreign Application Priority Data

Sep. 14, 1977 [GB] United Kingdom ..... 38289/77

[51] Int. Cl.[3] ..... D01H 15/02

[52] U.S. Cl. ..... 57/263

[58] Field of Search ..... 57/261, 263

[56] References Cited

U.S. PATENT DOCUMENTS

| | | | |
|---|---|---|---|
| 3,601,969 | 8/1971 | Susami et al. | 57/263 X |
| 3,678,673 | 7/1972 | Prochazka et al. | 57/263 X |
| 3,680,300 | 8/1972 | Landwohrkarp | 57/263 |
| 3,803,823 | 4/1974 | Niestroj et al. | 57/263 |
| 3,821,878 | 7/1974 | Parsons | 57/263 |
| 3,858,385 | 1/1975 | Shinkai et al. | 57/263 |
| 4,041,685 | 8/1977 | Grau | 57/263 |
| 4,083,169 | 4/1978 | Lane | 57/263 |

*Primary Examiner*—Donald Watkins
*Attorney, Agent, or Firm*—Donald H. Feldman

[57] ABSTRACT

The invention relates to apparatus for piecing-up yarn on an open-end spinning machine.

A yarn reserve forming member is movable between an extended position, in which it constrains the yarn to follow a prescribed reserve yarn path, and a retracted position, in which the yarn follows another prescribed and shortened path and the end of yarn and its length, which is the difference between the lengths of said prescribed paths, is permitted to return to the spinning means to contact fibres fed thereto.

To achieve efficient piecing-up, the yarn moves between such prescribed pathways from one to the other under control of the reserve forming member while the reserve yarn path is in a sense depleted and the yarn is caused by yarn insertion means to be inserted in the delivery roiler nip at a predetermined position in the course of movement by the reserve forming member when the latter moves to the retracted position.

Preferably, the yarn is engaged by a yarn retaining means when in the extended position from which it is released by the resultant tension in the yarn at the end of the movement of the reserve forming member to the retracted position.

13 Claims, 4 Drawing Figures

YARN PIECING DEVICE FOR OPEN-END SPINNING MACHINES

FIELD OF THE INVENTION

This invention relates to apparatus for piecing-up yarn in an open-end spinning machine having spinning means for forming a spun yarn from fibres fed thereto and a pair of yarn delivery rollers defining a nip of predetermined length by means of which yarn is delivered from the spinning means, the yarn piecing-up apparatus being of the type comprising a yarn reserve forming member movable between an extended position in which the yarn is constrained by the reserve forming member so as to follow a reserve yarn path and a retracted position in which the yarn is permitted to follow a shortened path whereby an end of the yarn is permitted to be returned to the spinning means to contact fibres fed thereto.

BACKGROUND OF THE INVENTION

A great deal of effort has been expended in the search for satisfactory yarn piecing-up devices which will facilitate the efficient connection between a tail end of previously spun yarn with fibres fed to the spinning means.

For example, in British Pat. No. 1 444 497 a piecing-up device is disclosed which is in portable form so that it can be coupled to the machine at a defective spinning station where yarn piecing is required. The device includes a yarn reserve forming member in the form of a retractable pin around which the yarn extending from the package is passed so as to form a reserve length of yarn in the path between the yarn delivery rollers and the package. Upon actuation of the device, the pin is retracted out of the path of the yarn and in a direction transverse thereto so as to permit the yarn to return to the normal spinning path.

It is believed that such a piecing-up device would not operate to a satisfactory degree of efficiency, because of the lack of control over the yarn and its pathway or yarnline as it returns to the normal spinning path and into the delivery roller nip. After the yarn has been released from the pin, the reserve length of yarn is unsupported whilst it is eliminated by accumulation of the yarn on the package and by returning the end of yarn into the spinning means. Furthermore, there is uncertainty introduced as to precisely when the yarn will enter the delivery roller nip, and this uncertainty is increased because the yarn and its pathway or yarnline are uncontrolled and thus not prescribable during its return from the extended yarn path to the normal spinning path. If the yarn enters the delivery roller nip at indeterminate, which is to say unpredictable and uncontrollable, times during the piecing-up procedure, then the critical, precise moment of commencement of delivery of yarn from the spinning means is also indeterminate.

A further piecing-up device is disclosed in British Pat. No. 1 457 741 which is provided with two reserve length supporting members so that a first reserve length of yarn is formed between the delivery rollers and the package, and a second reserve length of yarn formed between the delivery rollers and the spinning means. The reserve lengths are released by removal of the supporting members and permitting the yarn to return to the normal spinning path in an uncontrolled manner.

The supporting members for the reserve length of yarn are positioned outside the length of the nip line defined by the delivery rollers and it has been found necessary to provide a mechanism having a guide which is movable so as to positively place the yarn into the delivery roller nip. Although this mechanism does provide some predictability as to the moment when delivery of yarn from the spinning means will be resumed, it adds to the complication of the device, and to its cost.

British Pat. No. 1 291 900 discloses a further piecing-up mechanism utilising a reserve length of yarn which can be reduced so as to permit the end of yarn to return to the spinning means to effect the piecing.

The support for the reserve length of yarn is a pin protruding from a rotatable disc to which it is attached. When the disc is rotated the pin remains in contact with the yarn and thereby exercises some control over the yarn as it returns to the normal spinning path.

In the arrangement shown in this specification, the yarn is placed in the delivery roller nip before releasing the reserve length of yarn and is thus applicable only to piecing-up during a starting of all the stations of the machine. Since piecing-up of a broken yarn at an individual station has to take place with the delivery rollers in rotation, this known arrangement is unsuitable for such situations.

OBJECT OF THE INVENTION

It is an object of the invention to provide a yarn piecing-up apparatus which exercises control over the yarn during the piecing-up operation, thereby contributing to an efficient piecing-up procedure. Another object of the invention is to ensure that insertion of the yarn into the delivery roller nip, whereby delivery of spun yarn is resumed, takes place at a predetermined moment during the procedure.

SUMMARY OF THE INVENTION

These and other desirable objects are attained according to the invention by providing means whereby the reserve forming member is moved with the yarn to the retracted position and such that at a predetermined position and thus moment in the course of such movement of the reserve forming member the yarn is caused to be inserted in the delivery roller nip.

Preferably, the yarn piecing-up apparatus further comprises yarn retaining means for engaging the yarn when the reserve forming member is in the extended position and for releasing the engaged yarn at the predetermined position and thus moment aforesaid in the course of movement of the reserve forming member to the retracted position.

Preferably, the yarn is constrained to follow the reserve yarn path between the spinning means and the yarn delivery rollers.

Preferably, the reserve length of the yarn engages the yarn retaining means after contact with the reserve forming member.

The yarn retaining means is positioned beyond the length of the nip defined by the delivery rollers, so that the yarn is released from the yarn retaining means by the resultant tension in the yarn.

The advantages of the invention lie in the fact that the yarn is controlled by the reserve forming member whilst the reserve yarn path is shortened to the normal spinning path and that the yarn is inserted into the delivery roller nip at a predetermined position of the reserve forming member.

DESCRIPTION OF THE PREFERRED EMBODIMENT

Figure 1:
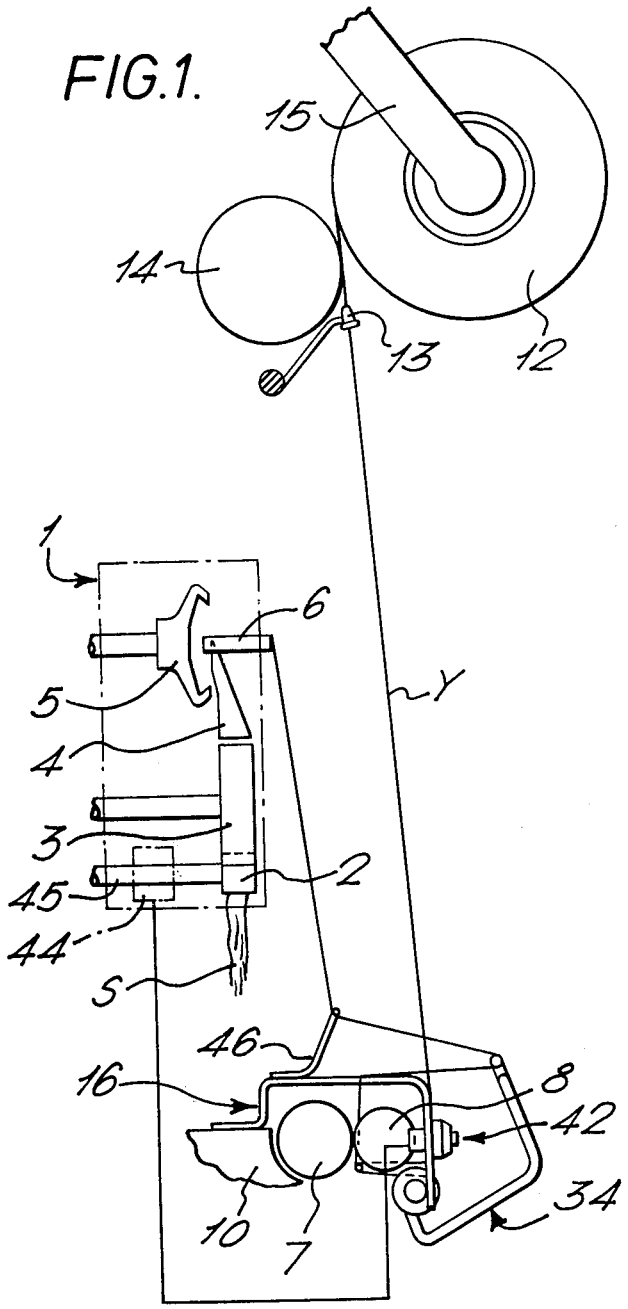
FIG. 1 is a diagrammatic cross-sectional representation of an open-end spinning machine in which the yarn path is indicated in the pre-piecing position.

Referring to FIG. 1, an open-end spinning machine has a spinning unit 1, to which in operation a sliver 'S' is supplied to be delivered by a rotating feed roller 2 to a rotating opening roller 3. The opening roller 3 has needles or saw-tooth type wire (not shown) provided around the peripheral surface thereof so that fibres are separated from the sliver 'S' and conveyed to the entrance of a fibre feed duct 4. The fibres are transferred along the feed duct 4 and emerge therefrom within the cavity of a spinning rotor 5 in which the fibres are accumulated at the maximum internal diameter thereof.

Figure 2:
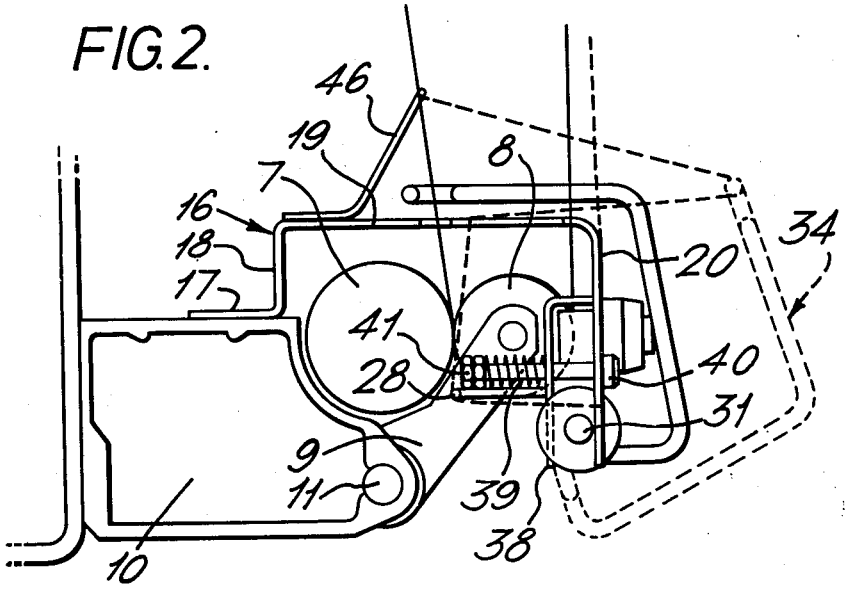
FIGS. 2, 3 and 4 are, respectively, side elevation, plan and front elevation of the yarn piecing-up apparatus shown in FIG. 1, with the pre-piecing yarn path indicated in broken line.

The fibres are withdrawn as spun yarn 'Y' from the spinning rotor 5 through a doffing tube 6 by a pair of rotating yarn delivery rollers 7, 8 which are positioned below the spinning 1 unit. The co-operating delivery roller 8 is mounted on an arm 9 which is pivotally connected to a bracket 10 by a fulcrum pin 11, as best seen in FIG. 2. After passing around the delivery roller 8, the yarn 'Y' travels upwardly to be distributed on a package 12 by a reciprocating traverse guide 13. The package 12 is normally in contact with a package driving roller 14 so as to derive rotation therefrom and is supported by a pair of package arms 15 which are pivotally connected to the machine frame (not shown).

Figure 3:
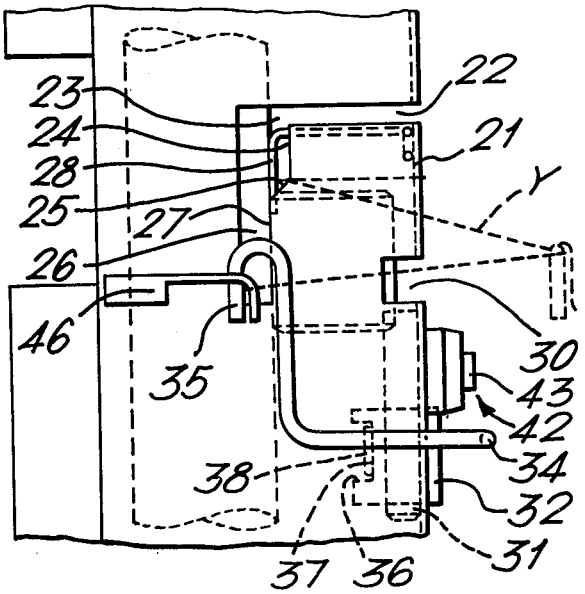
Figure 4:
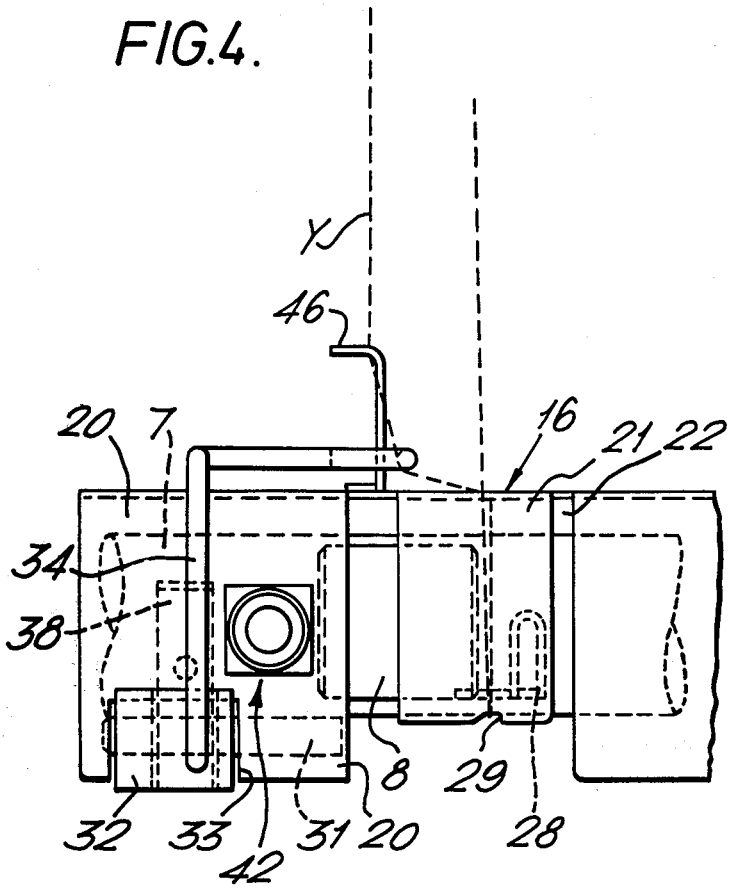

Attached to each of the brackets 10 is a sheet metal support 16 which extends along the machine and serves both as a support for the yarn piecing components and as a guard for yarn delivery rollers 7, 8. The support 16 is formed by a first horizontal portion 17 (FIG. 2) by which the support 16 is attached to the bracket 10, a vertical portion 18 and a horizontal top portion 19, which passes above both of the delivery rollers 7, 8 and terminates at a position forwardly thereof. Depending from the top portion 19 is a first vertical front apron 20 and a second vertical front apron 21 (FIGS. 3 and 4) of slightly shorter length than the first front apron 20. Both of the first and second front aprons 20, 21 extend below the bottom of the delivery rollers 7, 8, as best seen in FIG. 4.

At a position beyond the extent of the length of the nip formed between the delivery rollers 7, 8, a channel 22 is formed in the support 16 which extends rearwardly from the front apron 21 thereof to a position corresponding to the nip line. At this point, as best seen in FIG. 3, the channel 22 turns through a right angle to extend in a direction parallel to and above the nip line in an initial wide channel 23, which has a front surface 24 forwardly of the nip line and which narrows at a position corresponding to the start of the nip line by means of a chamfered guide surface 25 to form a narrow channel 26. The junction of the surface 24 and the chamfered guide surface 25 acts as a yarn retaining means adjacent to the nip line as hereinafter described. The narrow channel 26 has a front surface 27 which extends approximately above the nip line and the channel terminates towards the end thereof.

Attached to the lower extremity of the front apron 21 and approximately below the channel 22 is a wire yarn guide 28 which extends rearwardly to a position corresponding to the nip line. At this point the guide 28 is bent at right angles so as to extend parallel to and below the nip line and terminate within the length thereof.

A notch 29 (FIG. 4) is formed in the base of the front apron 21 at a position below the lower peripheral extent of the delivery rollers 7 and 8 which serves as a further yarn guide in a manner hereinafter to be described.

The front aprons 20, 21 of the support 16 are separated by an inlet 30 which extends rearwardly so as to expose a portion of the peripheral surface of the delivery roller 8 when seen in plan view as in FIG. 3 and permits the yarn 'Y' to travel upwardly to the traverse guide 13 during normal spinning operation.

At the lower extremity of the front apron 20 a pivot pin 31 is mounted on the inner surface thereof. A boss 32, partially protruding through an aperture 33 formed in the front apron 20, is pivotally mounted on the pivot pin 31 and serves to support a yarn reserve forming member 34. The yarn reserve forming member 34 is in the form of an arm extending from the boss 32 upwardly in front of the front apron 20 and then rearwardly across the horizontal top portion 19 of the support 16. The reserve forming member 34 terminates in a yarn engaging hook 35 above the narrow channel 26 so that during normal spinning operation the yarn 'Y' passes to the nip line through the hook 35 and the narrow channel 26 but without contact therewith.

A recess 36 (FIG. 3) is formed in the boss 32 to provide a flat 37 against which is resiliently biased a finger 38 so as to retain the reserve forming member 34 in a retracted position as shown in full line in FIGS. 2, 3 and 4. A compression spring 39 (FIG. 2) encircles a bolt 40 which passes through the front apron 20 and through a clearance hole in the finger 38. The spring 39 reacts between the finger 38 and a nut 41 screwed on the end of the bolt 40 to produce the biasing effect of the finger 38.

The reserve forming member 34 can be pivoted to an extended position by rotational movement of the boss 32 on the pin 31 as shown in full lines in FIG. 1 and in broken lines as shown in FIG. 2 and 3 for the purpose hereinafter described.

Mounted on the front apron 20 of the support 16 is a fibre feed control switch 42 having a push button 43. The switch 42 is operatively connected to a clutch 44 (FIG. 1) mounted on a shaft 45 on which is supported the feed roller 2. Actuation of the switch 42 thus controls operation of the clutch 44 and thereby the feed roller 2 so as to stop and start the feed of sliver 'S' to the opening roller 3.

Attached to the horizontal top portion 19 of the support 16 is a yarn engaging finger 46 which provides a location for the yarn 'Y' when in the pre-piecing position, i.e. when the yarn reserve forming member 34 constrains the yarn 'Y' to follow an extended path, as shown in full lines in FIG. 1.

In operation the yarn piecing-up procedure is carried out as follows:

The yarn package 12 is taken out of contact with the package driving roller 14 so that a small clearance is formed between the peripheral surface of the package 12 and the peripheral surface of the package driving roller 14. The yarn reserve forming member 34 is moved pivotably forward into an extended position as shown in full lines in FIG. 1 and in broken line in FIG. 2.

The yarn 'Y' is then threaded-up into the pre-piecing path.

Specifically, the end of yarn is found on the package 12 and a length of yarn 'Y' is unwound therefrom. This length of yarn 'Y' is extended downwardly towards the yarn delivery rollers 7 and 8 and passed beneath the front apron 21 (FIG. 4) so as to engage the notch 29 as the yarn extends rearwardly towards the yarn guide 28. From the yarn guide 28, as best seen in FIG. 2, the yarn is taken upwardly so as to pass through the channel 23 and then forwardly to engage the hook end 35 of the yarn reserve forming member 34. In its passage between the yarn guide 28 and the hook end 35 the yarn is retained in the junction formed by the intersection of the chamfered guide surface 25 and the surface 24. As best seen in FIG. 3, this junction lies to one side of the delivery roller 8 and outside the nip length formed by the delivery rollers 7 and 8 and the hook end 35 is located so as to correspond with a point within the nip length. Thus the yarn travels forwardly and inwardly in its path between the junction of the surfaces 24, 25 and the hook end 35. From the hook end 35 the yarn engages the yarn engaging finger 46 and is then taken upwardly into the vicinity of the doffing tube 6 and cut to a predetermined length. The cut end of the yarn is then passed down the doffing tube 6 whereby the yarn, due to the sub-atmospheric pressure existing within the spinning rotor 5, is held in a tensioned condition.

With the spinning rotor 5 and the opening roller 3 in rotation, the operative depresses the push button 43 of the switch 42 which actuates the clutch 44 thereby to commence rotation of the feed roller 2. Thus the sliver 'S' is forwarded to the opening action effected by the opening roller 3 and the opened fibres are delivered into the cavity of the spinning rotor 5 to accumulate on the maximum diameter thereof.

Immediately after depression of the push button 43, the operative flicks the yarn reserve forming lever 34 so that it moves with the yarn 'Y' towards the retracted position, as shown in FIGS. 2, 3 and 4. This movement is aided by the finger 38 acting on the boss 32 to produce a biassing effect thereon so as to return the reserve forming lever to the retracted position. During return of the yarn 'Y' from the extended path to the shortened path it is advantageously controlled by the hook end 35 of the reserve forming member 34.

The end of the yarn 'Y' is thus permitted to return to the maximum internal diameter of the spinning rotor 5 where it contacts and twists in the fibres previously fed thereto. The whole of the reserve length of yarn is utilised in allowing the yarn end to return to the spinning rotor 5, since the yarn 'Y' is not permitted to enter the delivery roller nip until the reserve forming lever 34 attains, or substantially attains, the retracted position. More specifically, the yarn is retained in the junction of the surfaces 24 and 25 until the yarn engaging hook end 35 reaches a position such that the yarn extending between this junction and the hook end 35 lies parallel to the line of the delivery roller nip. At this point the resultant force acting on the yarn extending between the junction and the hook end 35 is such that the yarn is pulled sideways out of the said yarn retaining junction, along the chamfered guide surface 25 and along the yarn guide 28 so as to be guided for insertion into the delivery roller nip.

The rotation of the delivery rollers 7, 8 causes delivery of spun yarn to commence and the yarn is automatically taken out of the notch 29 and pulled sideways along the front apron 21 until it enters the inlet 30 to contact the delivery roller 8 around approximately 180° of its peripheral surface.

The package 12 is then brought into contact with the package driving roller 14 and the yarn is caught by the reciprocating yarn guide 13 so that the newly spun yarn 'Y' is distributed and collected on the package 12.

It is possible with this invention to exercise close control over the yarn during its return from the extended yarn path to the shortened yarn path, and to determine when the yarn is inserted into the delivery roller nip so that normal delivery of spun yarn can proceed. These features have contributed towards an efficient piecing-up procedure, even at high yarn production rates.

I claim:

1. A device to aid in the piecing up of yarn with fibres within a spinning means of an open-end spinning machine having a pair of delivery or yarn doffing rollers defining therebetween a nipline or a line of nip contact of the rollers one with the other for engaging and delivering yarn from said spinning means, and also having means for feeding discrete fibres to said spinning means for joining or piecing with said yarn, said piecing aid device including yarn pathway forming and yarn guiding means for (a) forming a first yarn pathway outside of said nipline to define a specific reserve length of yarn sufficient to be fed back into said spinning means and there to join with said fibres, and for guiding said yarn into said first yarn pathway, for (b) forming a second yarn pathway intersecting said nipline to define the courseway for yarn during spinning by said machine, and for guiding said yarn into said second pathway, and for (c) forming the plurality of yarn pathways intermediate said first and second yarn pathways to define the change in yarn pathways during piecing with said device, and for guiding said yarn into and through said intermediate pathways in moving the same from said first to said second pathways.

2. A device according to claim 1, wherein said yarn pathway means includes yarn reserve forming means for forming said reserve length of yarn in said first yarn pathway, said forming means including a member movable between an extended position in said first pathway and outward from said machine and a retracted position inward toward said machine and adjacent said second pathway, and yarn guiding and nip insertion means for (i) guiding said yarn during piecing from said first pathway through said plurality of intermediate pathways to said second pathway, and for (ii) causing said yarn to be inserted into the nip between said rollers during the change from one of said intermediate pathways to another.

3. A device according to claim 2, wherein said yarn guiding and nip insertion means includes yarn retaining means for engaging said yarn when said reserve forming member is at its extended position and for releasing said yarn when said reserve forming member passes through a predetermined position in moving from said first pathway toward said second pathway.

4. A device according to claim 3, wherein said yarn retaining means intersects said first yarn pathway and is fixed adjacent said second yarn pathway.

5. A device according to claim 3, wherein a portion of said first pathway extends between said yarn retaining means and said movable member when the latter is in its extended position, and is defined by the distance therebetween.

6. A device according to claim 3, wherein said predetermined position is adjacent to said retracted position.

7. A device according to claim 2, wherein the reserve forming member is movable from the extended position to the retracted position in a direction transverse to the direction of the nipline and within its length.

8. A device according to claim 7, wherein the reserve forming member is a lever pivotably mounted about an axis parallel to the nipline.

9. A device according to claim 2, wherein the reserve forming member is movable from the extended position to the retracted position under resilient bias by a spring interconnected therewith.

10. A device according to claim 3, wherein the yarn retaining means comprises two guiding surfaces and a junction of the two surfaces, the latter intersecting said first yarn pathway and whereat the yarn is retained when the reserve forming member is in the extended position, the junction being at a position between the spinning means and the yarn delivery rollers, and one of the two surfaces extending from the junction toward the nip of the yarn delivery rollers to form a guide surface along which the yarn is guided into the nip when released from the junction.

11. A device according to claim 10, wherein the junction of the two surfaces is adjacent to the nip.

12. A device according to claim 10, wherein the other surface extends in a direction parallel to the nipline and defines with the one guide surface an obtuse angle.

13. A device according to claim 10, wherein the yarn guiding and nip insertion means further includes a guide surface positioned on the opposite side of the nip from the junction when considered in the direction of the first yarnpath.

* * * * *